US009954300B2

(12) United States Patent
Nagasaka et al.

(10) Patent No.: US 9,954,300 B2
(45) Date of Patent: Apr. 24, 2018

(54) CONNECTOR

(71) Applicant: YAZAKI CORPORATION, Tokyo (JP)

(72) Inventors: Naokazu Nagasaka, Shizuoka (JP); Ederlin Mesa Domingo, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/657,806

(22) Filed: Jul. 24, 2017

(65) Prior Publication Data

US 2018/0034185 A1 Feb. 1, 2018

(30) Foreign Application Priority Data

Jul. 28, 2016 (JP) ..... 2016-148492

(51) Int. Cl.
*H01R 13/428* (2006.01)

(52) U.S. Cl.
CPC ..... *H01R 13/428* (2013.01)

(58) Field of Classification Search
CPC .. H01R 13/428; H01R 13/422; H01R 13/424; H01R 13/64
USPC ..... 439/595, 680, 744, 747, 871
See application file for complete search history.

(56) References Cited

U.S. PATENT DOCUMENTS 6,589,080 B2 * 7/2003 Tanaka ..... H01R 13/4226 439/595
6,623,313 B1 9/2003 Ichida et al.
6,676,448 B2 * 1/2004 Kato ..... H01R 13/4223 439/595
2003/0049965 A1 3/2003 Fujita et al.
2003/0049975 A1 3/2003 Tsuji et al.
2003/0228793 A1 12/2003 Ichida et al.
2003/0228795 A1 12/2003 Ichida et al.
2003/0228796 A1 12/2003 Nankou et al.
2003/0228797 A1 12/2003 Ishikawa et al.
2003/0228798 A1 12/2003 Nankou et al.
2005/0032424 A1 2/2005 Ichida et al.
2015/0333427 A1 * 11/2015 Taguchi ..... H01R 13/428 439/748
2016/0072218 A1 * 3/2016 Chiba ..... H01R 13/5202 439/587

FOREIGN PATENT DOCUMENTS

JP 2004-63078 A 2/2004

* cited by examiner

*Primary Examiner* — Tulsidas C Patel
*Assistant Examiner* — Travis Chambers
(74) *Attorney, Agent, or Firm* — Kenealy Vaidya LLP

(57) ABSTRACT

A connector includes a female terminal having a tubular electric connection portion, and a housing having a terminal receiving chamber. The electric connection portion includes a bottom wall, side walls, a plate spring, a top wall overlaid on an outer side of the plate spring, a plurality of top wall holding protrusions overlaid on an outer side of the first side wall, and lock portions provided contiguously with the top wall holding protrusions and locked at the reception holes of the first side wall. An inner wall of the terminal receiving chamber of the housing includes an engagement groove provided in a recessed manner along a direction in which the female direction is inserted into the terminal receiving chamber. The engagement groove engages with the top wall holding protrusions on the outer side of the first side wall to guide the insertion of the female terminal.

3 Claims, 13 Drawing Sheets

CONNECTOR

CROSS-REFERENCE TO RELATED APPLICATION

The present application claims priority from Japanese Patent Application No, 2016-148492 filed on Jul. 23, 2016, the entire content of which is incorporated herein by reference.

FIELD OF INVENTION

The present invention relates to a connector to be fitted to a counterpart connector.

RELATED ART

A related art connector has a tubular electric connection portion opened at its front and back, and a protrusion is provided on the electric connection portion such that the protrusion is fitted into a supporting groove formed in a recessed manner on an inner surface of a cavity (a terminal receiving chamber) of a housing, whereby the terminal is regulated so as not to tilt in a deflection direction of a lance (see, e.g. JP2004-63078A).

The connector is, for example, a female connector in which a female terminal fitting 530 is inserted into a female housing 510 as shown in FIG. 13 and FIG. 14. An inner circumferential surface of a cavity 511 has a side face, e.g., the left side face in FIG. 14, extending in an up-down direction (a deflection direction of a lance 513), and a supporting groove 560 is formed in a recessed manner on the side surface so as to be opened at its rear end, so that a protrusion 562 of the female terminal fitting 530 can be fitted into the supporting groove 560. The supporting groove 560 is formed into a substantially rectangular shape when viewed from the rear. The supporting groove 560 is disposed substantially at the center of the left side face of the cavity 511 in the up-down direction, while a front end position of the supporting groove 560 is set at a slightly rear position from a front face of the cavity 511. Upper and lower surfaces 560*a*, 560*b* of the supporting groove 560 for receiving the protrusion 562 are linearly formed in a width direction, which is a direction perpendicular to the deflection direction of the lance 513.

In the female terminal fitting 530, as shown in FIG. 13, the protrusion 562 that can be fitted into the supporting groove 560 is provided to protrude outward on a right side wall 535 of a body portion 531 (the electric connection portion). When the protrusion 562 is fitted into the supporting groove 560 as the female terminal fitting 530 is inserted into the cavity 511, upper and lower surfaces of the protrusion 562 are engaged with the upper and lower surfaces 560*a*, 560*b* of the supporting groove 560. The protrusion 562 is disposed substantially at the center in the up-down direction and on the front side from the center in the front-rear direction.

Thus, the protrusion 562 is fitted into the supporting groove 560 in a state in which the upper and lower surfaces of the protrusion 562 and the upper and lower surfaces 560*a*, 560*b* of the supporting groove 560 are engaged with each other (see FIG. 14). Accordingly, the female terminal fitting 530 is regulated so as not to tilt in the deflection direction of the lance 513.

However, the female terminal fitting 530 cannot be sufficiently regulated from tilting in the up-down direction only by the protrusion 562 disposed in a position longitudinally closer to the front on the side wall 535 as in the connector described above. That is, the female terminal fitting 530 inserted into the cavity 511 may tilt with the protrusion 562 being a rotation center when a tensile force in the up-down direction is applied on an electric wire 520 led out from the cavity 511, in which case in electric connection reliability may be deteriorated due to a variation in contact pressure with a counterpart male terminal.

In addition, when the female terminal fitting 530 is inserted into the cavity 511 in a tilted state, insertion friction with the cavity 511 is increased, so that terminal insertability may be deteriorated.

SUMMARY

Illustrative aspects of the present invention provide a connector having improved electric connection reliability and terminal insertability.

According to an illustrative aspect of the present invention, a connector includes a female terminal having a tubular electric connection portion, and a housing having a terminal receiving chamber in which the female terminal is inserted along a longitudinal direction of the female terminal. The connector is configured such that, when the connector is fitted to a counterpart connector, a male terminal of the counterpart connector is inserted into the electric connection portion of the female terminal in the longitudinal direction and is electrically connected to the electric connection portion. The electric connection portion includes a bottom wall, a first side wall having a plurality of reception holes, a second side wall, the first side wall and the second side wall extending upright from respective sides of the bottom wall, the respective sides of the bottom wall extending in the longitudinal direction of the female terminal, a plate spring provided contiguously with the first side wall and extending in the longitudinal direction so as to face the bottom wall, a top wall provided contiguously with the second side wall and overlaid on an outer side of the plate spring, a plurality of top wall holding protrusions provided contiguously with the top wall and overlaid on an outer side of the first side wall, and lock portions provided contiguously with the top wall holding protrusions and locked at the reception holes of the first side wall. The electric connection portion is bent at a boundary between the first side wall and the plate spring, at a boundary between the second side wall and the top wall, at a boundary between the top wall and the top wall holding protrusions, and at a boundary between the top wall holding protrusions and the lock portions. An inner wall of the terminal receiving chamber of the housing includes an engagement groove provided in a recessed manner along the longitudinal direction. The engagement groove engages with the top wall holding protrusions on the outer side of the first side wall to guide the female terminal such that the female terminal is inserted into the terminal receiving chamber along the longitudinal direction.

Other aspects and advantages of the invention will be apparent from the following description, the drawings and the claims.

DETAILED DESCRIPTION

Hereinafter, exemplary embodiments of the present invention will be described with reference to the drawings.

Figure 1:
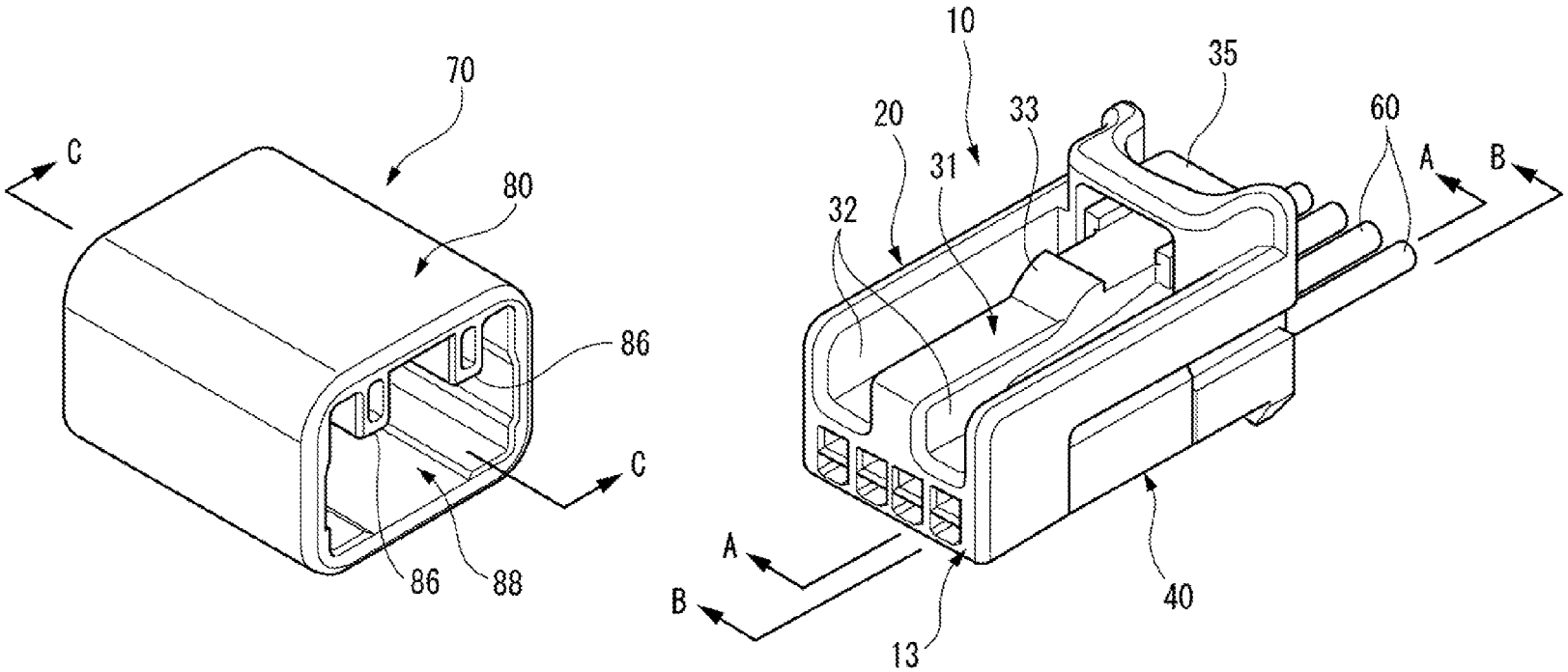
FIG. 1 is a perspective view of a connector and a counterpart connector according to an exemplary embodiment of the invention.
Figure 2:
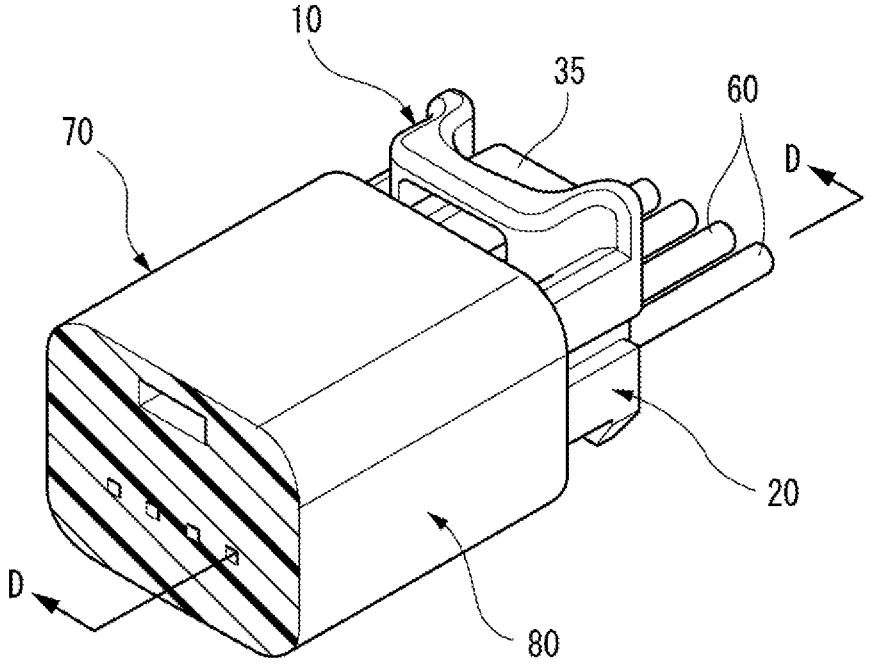
FIG. 2 is a partially cutaway perspective view of the counterpart connector and the connector fitted to each other.

FIG. 1 is a perspective view of a connector 10 and a counterpart connector 70. FIG. 2 is a partially cutaway perspective view of the counterpart connector 70 and the connector 10 fitted to each other.

As shown in FIG. 1 and FIG. 2, the connector 10 according to the exemplary embodiment is fitted to the counterpart connector 70.

In the connector 10, the front end side on the front side in the fitting direction to the counterpart connector 70 serves as a fitting portion 13. The counterpart connector 70 has a fitting recess portion 88 opened on its front end side, which is the front side in the fitting direction to the connector 10. When the fitting portion 13 of the connector 10 is fitted to the fitting recess portion 88 of the counterpart connector 70, the connector 10 is connected to the counterpart connector 70.

Figure 4:
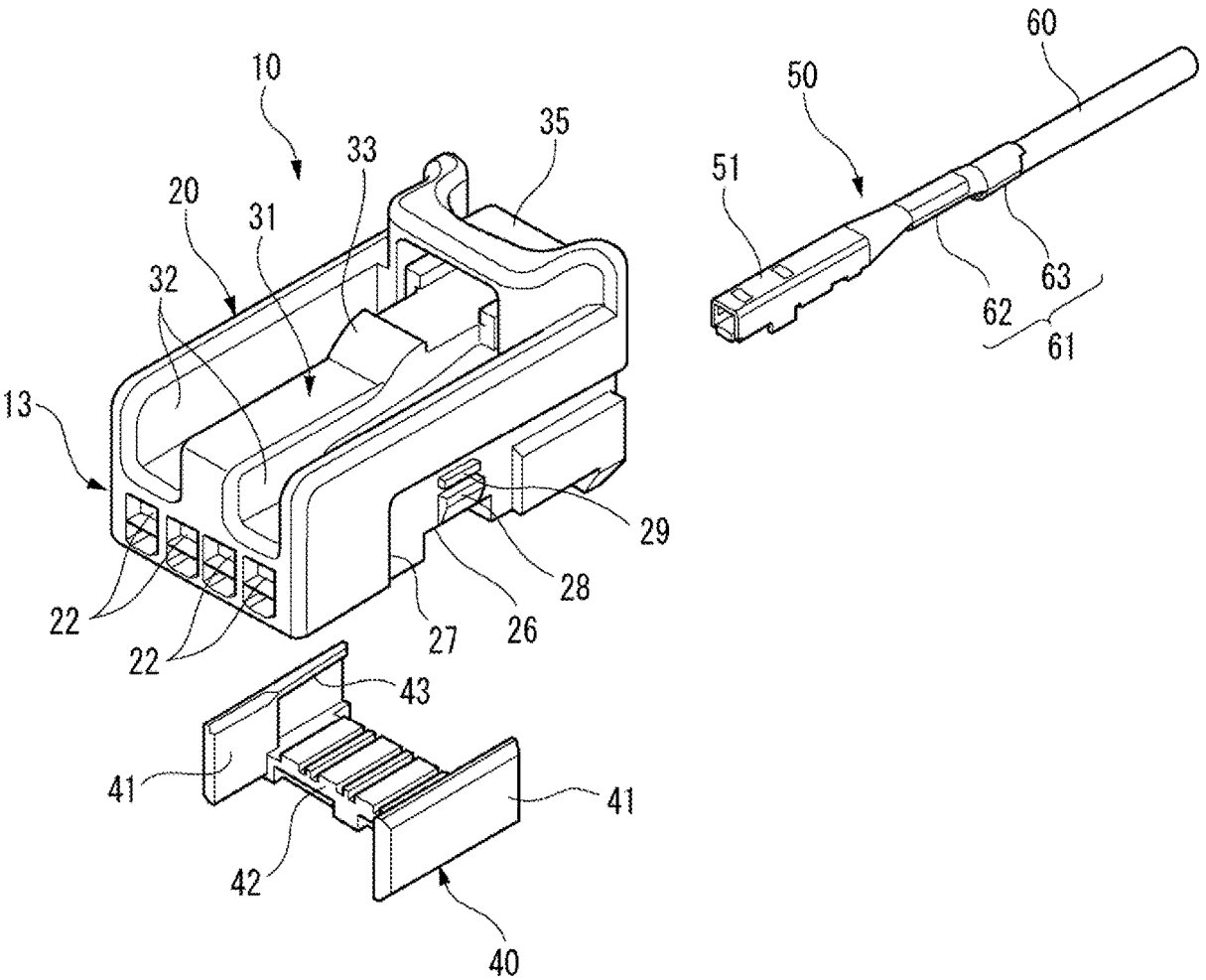
FIG. 4 is an exploded perspective view of the connector.
Figure 5A:
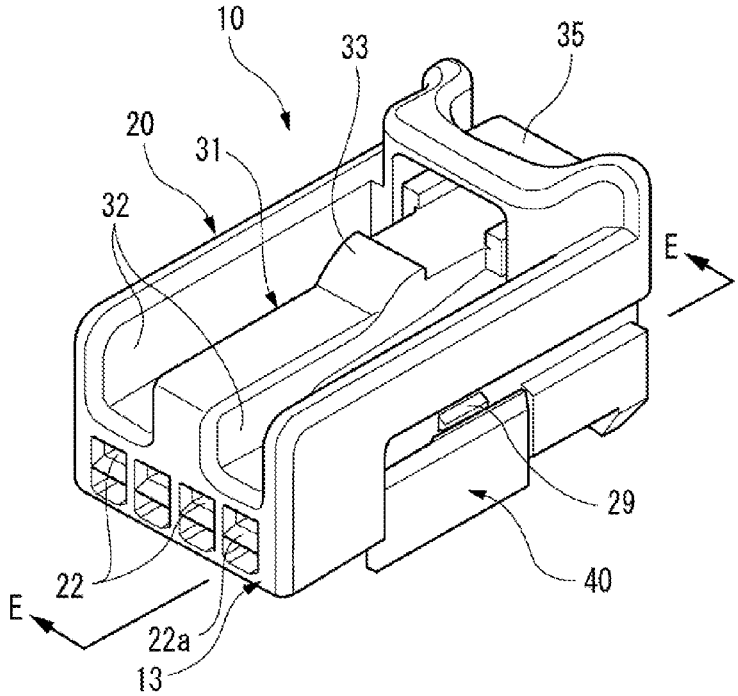
FIG. 5A is a perspective view of a housing of the connector.
Figure 5B:
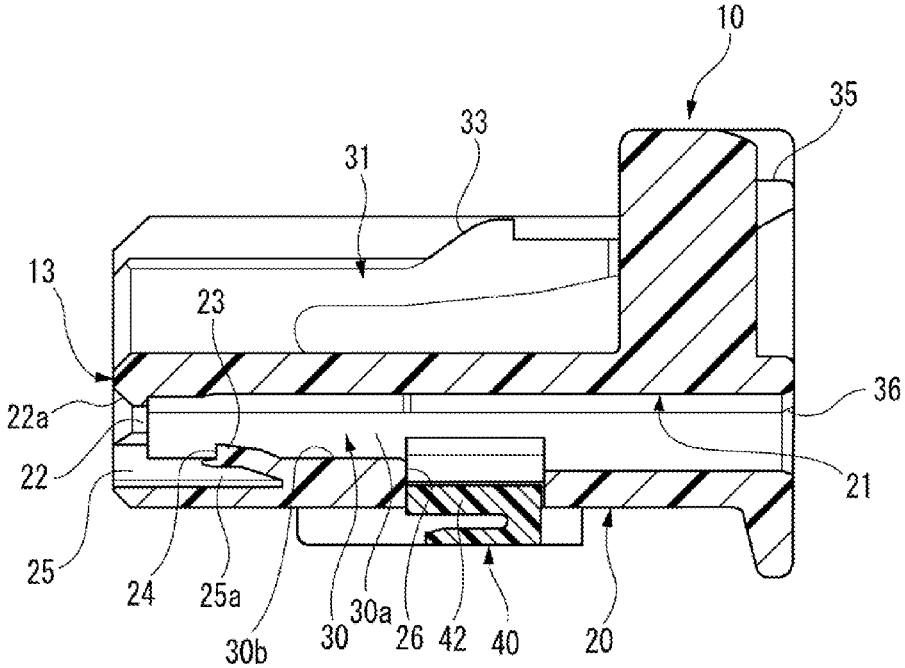
FIG. 5B is a sectional view taken along the line E-E in FIG. 5A.

FIG. 4 is an exploded perspective view of the connector 10 according to the exemplary embodiment. FIG. 5A is a perspective view of a housing 20 according to the exemplary embodiment. FIG. 5B is a sectional view of the housing 20 taken along the line E-E in FIG. 5A.

As shown in FIG. 4 and FIGS. 5A and 5B, the connector 10 has a female terminal 50 including a tubular electric connection portion 51, a female housing 20 that is a housing including terminal receiving chambers 21 housing female terminals 50, and a retainer 40 locking the female terminals 50 housed in the terminal receiving chambers 21.

The female housing 20 is molded out of electrically insulating resin. The front end side of the female housing 20 serves as the fitting portion 13. The female housing 20 includes a plurality (four in the exemplary embodiment) of terminal receiving chambers 21. The terminal receiving chambers 21 are formed to extend in the fitting direction to the counterpart connector 70, and arranged in a line in the width direction of the female housing 20. Each terminal receiving chamber 21 has an opening portion 22 on the front end side of the female housing 20.

Each terminal receiving chamber 21 of the female housing 20 includes a lance 23. The lance 23 is a flexible lock piece protruding inward from one side surface of the terminal receiving chamber 21. The lance 23 is formed into a cantilever-like shape extending frontward. The front end side of the lance 23 enters the terminal receiving chamber 21. In addition, the lance 23 has a lock step portion 24 on the terminal receiving chamber 21 side at the front end of the lance 23. A space portion 25 is formed on the lance 23 side (illustrated lower side) of the opening portion 22 on the front end side of the female housing 20. A flexible space 25*a* constituted by a part of the space portion 25 is provided on the opposite side of the lance 23 to the terminal receiving chamber 21.

The space portion 25 is a hole provided exclusively for molding the lance 23 independently of the opening portion 22. The space portion 25 is provided such that the opening portion 22 does not overlap the lance 23. Thus, four terminal insertion guide faces 22*a* are formed at the opening edge of the opening portion 22 so as to be circumferentially contiguous with each other like four faces of a quadrangular pyramid. Due to the terminal insertion guide faces 22*a*, a male terminal 90 can enter the opening portion 22 smoothly. In addition, the lance 23 can be molded with no restriction to form the terminal insertion guide faces 22*a*. Therefore, the lock step portion 24 and the lance itself can be formed to be wide enough to enhance a terminal holding force for the female terminal 50.

An engagement recess portion 26 reaching the terminal receiving chambers 21 is formed in a lower portion of the female housing 20 on the lance 23 side. Further, in the female housing 20, mounting recess portions 27 are formed on opposite side surfaces including the opposite sides of the engagement recess portion 26. In the place where each mounting recess portion 27 is formed in the female housing 20, a temporary lock protrusion 28 and a final lock protrusion 29 are formed in order from below.

Figure 7:
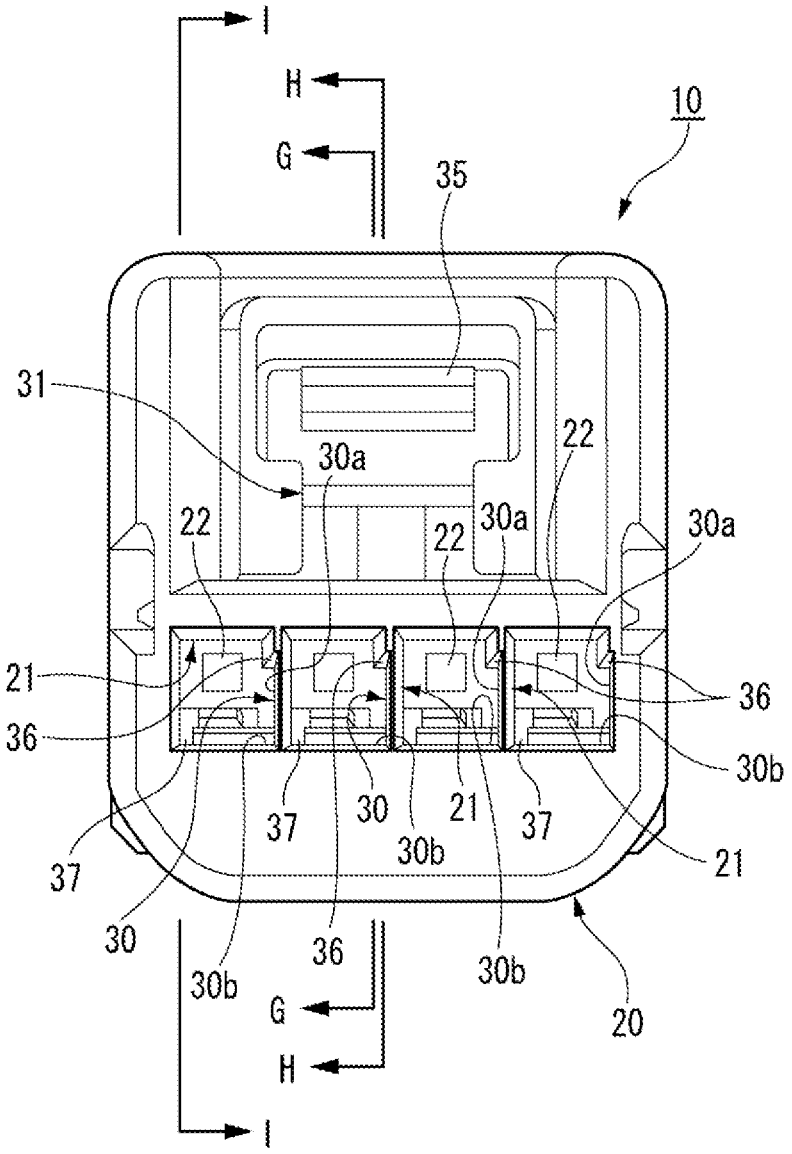
FIG. 7 is a rear view of the housing shown in FIG. 4.

Of the inner circumferential walls in each terminal receiving chamber 21 of the female housing 20, the right inner wall in FIG. 7 opposed to a first side wall 71 of the female terminal 50 has an engagement groove 30, which is provided and recessed to extend in a female terminal insertion direction so as to be opened rearward. The engagement groove 30 can be engaged with a plurality of top wall holding protrusions 75, 77 protruding outward from the first side wall 71 of the female terminal 50, which will be described later. The engagement groove 30 guides the top wall holding protrusions 75, 77 inserted therein.

The engagement groove 30 is formed into a substantially rectangular shape in view from the rear. The engagement groove 30 is disposed at a substantially central position in the up-down direction in the right side face of the terminal receiving chamber 21, and the front end position of the engagement groove 30 is set at the front face position of the terminal receiving chamber 21. Of the engagement groove 30, a bottom face 30*b* receiving the top wall holding protrusions 75, 77 under a side face 30*a* is formed straightly in the width direction which is a direction substantially perpendicular to the deflection direction of the lance 23.

In addition, a terminal guiding taper 36 for guiding the top wall holding protrusions 75, 77 into the engagement groove 30 is formed in a terminal insertion side end portion of the engagement groove 30.

Further, of the inner circumferential walls in each terminal receiving chamber 21 of the female housing 20, the lower inner wall in FIG. 7 opposed to a top wall 52 of the female terminal 50 has a guide groove 37, which is provided and recessed to extend in the female terminal insertion direction so as to be opened rearward. The guide groove 37 can be engaged with a stabilizer 78 of the female terminal 50, which will be described later. The engagement groove 30 engaged with the stabilizer 78 guides and inserts the female terminal 50 into the terminal receiving chamber 21.

The female housing 20 has a lock arm 31 and guide grooves 32. The lock arm 31 is provided at a central position in the width direction in an opposite surface (illustrated upper surface) of the female housing 20 to the surface where the engagement recess portion 26 is formed. The lock arm 31 is connected to the front end side of the female housing 20 so as to extend on the rear end side in the fitting direction to the counterpart connector 70. A lock claw 33 protruding upward is formed near a rear end of the lock arm 31. A pressing portion 35 is formed in a rear end portion of the lock arm 31. When the pressing portion 35 is pressed toward the female housing 20, the lock arm 31 is elastically deformed toward the female housing 20. The guide grooves 32 are formed on the opposite sides of the lock arm 31 so as to extend in the front-rear direction of the female housing 20.

The retainer 40 is molded out of electrically insulating resin. The retainer 40 includes a pair of side plates 41, and a lock block 42 provided between the side plates 41. The side plates 41 include lock portions 43 on their upper edges respectively. The lock portions 43 are protruded to the side where the lock portions 43 face each other. The retainer 40 is mounted on the female housing 20 from a lateral side (illustrated lower side) of the engagement recess portion 26. The retainer 40 is mounted on the female housing 20 so that the side plates 41 can be fitted into the mounting recess portions 27 of the female housing 20. Thus, the lock block 42 of the retainer 40 is fitted into the engagement recess portion 26.

In this manner, the retainer 40 mounted on the female housing 20 is mounted in a temporary lock state in which the lock portions 43 of the side plates 41 are locked to the temporary lock protrusions 28. In the temporary lock state, the lock block 42 fitted into the engagement recess portion 26 is set not to protrude into the terminal receiving chambers 21. When the retainer 40 is pushed toward the female housing 20 in the temporary lock state, the retainer 40 is mounted in a final lock state in which the lock portions 43 of the side plates 41 are locked to the final lock protrusions 29. In the final lock state, a part of the lock block 42 fitted into the engagement recess portion 26 protrudes into the terminal receiving chambers 21.

Figure 6A:
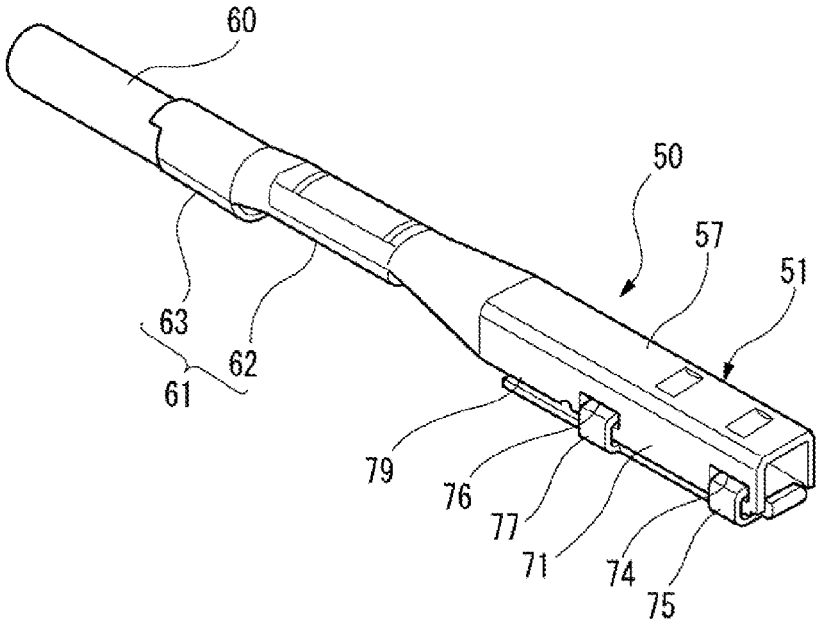
FIG. 6A is a perspective view of a female terminal of the connector viewed from lower left.
Figure 6B:
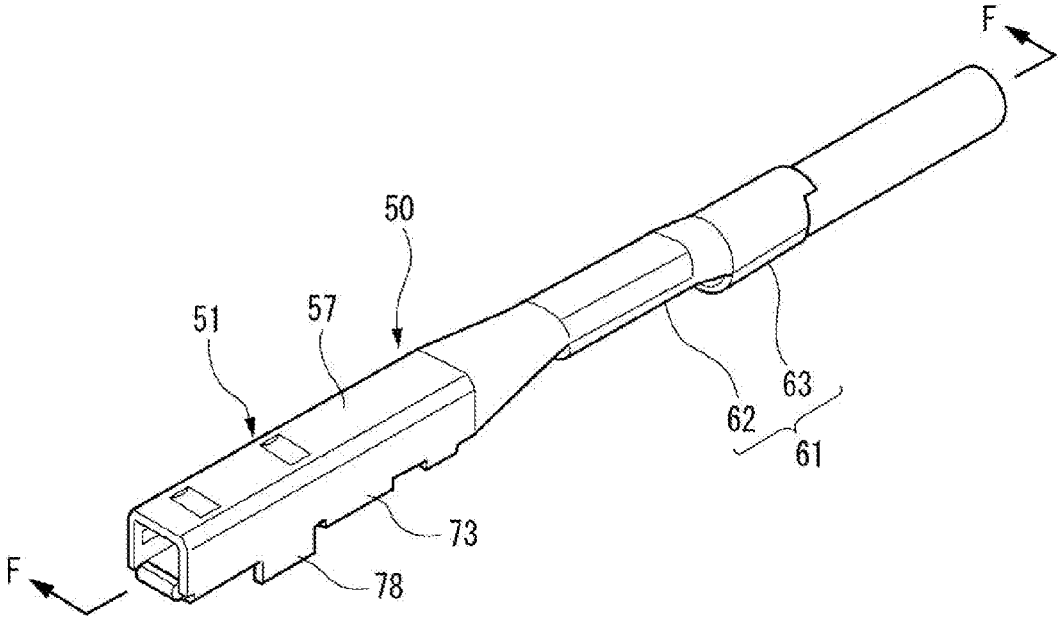
FIG. 6B is a perspective view of the female terminal viewed from lower right.
Figure 6C:
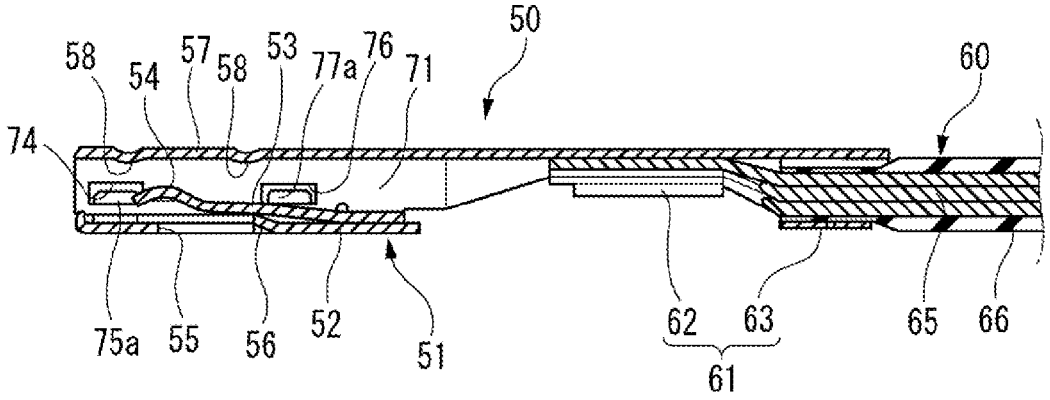
FIG. 6C is a sectional view taken along the line F-F in FIG. 6B.

FIGS. 6A to 6C are perspective views and a sectional view of the female terminal 50 according to the exemplary embodiment. The female terminal 50 in FIGS. 6A to 6C is depicted upside down in accordance with the terminal insertion direction in which the female terminal 50 is inserted into the terminal receiving chamber 21 of the female housing 20.

The female terminal 50 according to the exemplary embodiment is produced into a shape long and narrow in the front-rear direction as follows. That is, a conductive metal plate such as copper or a copper alloy is punched into a predetermined shape, and bending or the like is performed thereon. The electric connection portion 51 having a rectangular cylindrical shape is formed on the front end side of the female terminal 50. A crimping portion 61 to which an electric wire 60 is connected by crimping is formed on the rear end side of the female terminal 50. The electric wire 60 has a conductor 65 and an insulation 66 covering the conductor 65. An end portion of the electric wire 60 is electrically connected to the crimping portion 61 by crimping. The crimping portion 61 includes a conductor fastening portion 62 and an insulation fastening portion 63. The conductor fastening portion 62 is fastened to the conductor 65 exposed from the insulation 66 by crimping. The insulation fastening portion 63 is fastened to the insulation 66 by crimping.

The electric connection portion 51 is formed into a substantially rectangular parallelepiped box-like shape. The inside of the electric connection portion 51 serves as an insertion space for a male terminal 90. The electric connection portion 51 includes a bottom wall 57, a first side wall 71, a second side wall 73, a plate spring 53, a top wall 52, a plurality (two in the exemplary embodiment) of top wall holding protrusions 75, 77, lock portions 75*a*, 77*a*, and a stabilizer 78 (see FIG. 11). The first side wall 71 and the second side wall 73 extend upright from respective sides of the bottom wall 57, the respective sides of the bottom wall 57 that extend in a longitudinal direction of the female terminal 50. The plate spring 53 is provided contiguously with the first side wall 71. The plate spring 53 extends in the longitudinal direction (lateral direction in FIG. 6C) in which the male terminal 90 is inserted in the female terminal 50 so as to face the bottom wall 57. The top wall 52 is provided contiguously with the second side wall 73. The top wall 52 is overlaid on the outer side of the plate spring 53 so as to cover an upper opening. The top wall holding protrusions 75, 77 are provided contiguously with the top wall 52, and are overlaid on the outer side of the first side wall 71. The lock portions 75*a*, 77*a* are provided contiguously with the top wall holding protrusions 75, 77, and are locked at a plurality (two in the exemplary embodiment) of reception holes 74, 76 provided in the first side wall 71 respectively. The stabilizer 78 is provided to protrude at the upper edge of the second side wall 73. The electric connection portion 51 is bent at a boundary between the first side wall 71 and the plate spring 53, at a boundary between the second side wall 73 and the top wall 52, at a boundary between the top wall 52 and the top wall holding protrusions 75, 77, and at a boundary between the top wall holding protrusions 75, 77 and the lock portions 75*a*, 77*a*.

The plate spring 53 according to the exemplary embodiment is formed into a cantilever-like shape, which is bent at right angles from one end portion 79 of the first side wall 71 on the rear end side in its extending direction toward the second side wall 73, and extended to be long in front of the male terminal 90 and along the male terminal insertion direction so as to face the bottom wall 57. The plate spring 53 generates a contact load with the male terminal 90 at a contact point 54 swelling upward on the free end side of the plate spring 53. The female terminal 50 receives the male terminal 90 in the insertion space of the electric connection portion 51 so as to bring the plate spring 53 into elastic contact with the male terminal 90 to thereby establish electric connection thereto.

The reception holes 74, 76 are rectangular openings provided in the first side wall 71 and at positions corresponding to the lock portions 75*a*, 77*a* formed and bent at the front ends of the top wall holding protrusions 75, 77 respectively.

The lock portions 75*a*, 77*a* abut against hole opening edges 75 (see FIG. 11) of the reception holes 74, 76 provided in the first side wall 71. Thus, the lock portions 75*a*, 77*a* are locked to the reception holes 74, 76 respectively.

A lock hole 55 is formed in the top wall 52 of the electric connection portion 51. A rear edge portion of the lock hole 55 serves as a pressing portion 56, which is provided to protrude toward the plate spring 53. A base end portion of the plate spring 53 is pressed and supported by the pressing portion 56 so as to be pushed upward. Thus, the plate spring 53 is inclined upward gradually as goes to the front. The top wall holding protrusions 75, 77 and the reception holes 74, 76 disposed at predetermined intervals in the male terminal insertion direction of the electric connection portion 51 are disposed in front and at the rear of the contact point 54 in the male terminal insertion direction respectively. The contact point 54 is formed in the front end portion of the plate spring 54.

On the bottom wall 57 of the electric connection portion 51, two contact protrusions 58 are protruded toward the inside of the electric connection portion 51. The contact protrusions 58 are disposed at an interval in the front-rear direction. The contact point 54 of the plate spring 53 is disposed between the contact protrusions 58.

With the female terminal 50 according to the exemplary embodiment, the male terminal 90 is inserted into the insertion space of the electric connection portion 51, and the plate spring 53 comes in elastic contact with the male terminal 90. The load of the plate spring 53 in elastic contact with the male terminal 90 is supported by the top wall 52 overlaid on the outer side of the plate spring 53. The top wall 52 receiving the load from the plate spring 53 tries to be deformed in a direction in which the front end side of the bent part thereof leaves the first side wall 71 (in a direction in which the front end side floats up). That is, the top wall 52 of the box-like electric connection portion 51 tries to be opened.

Figure 11:
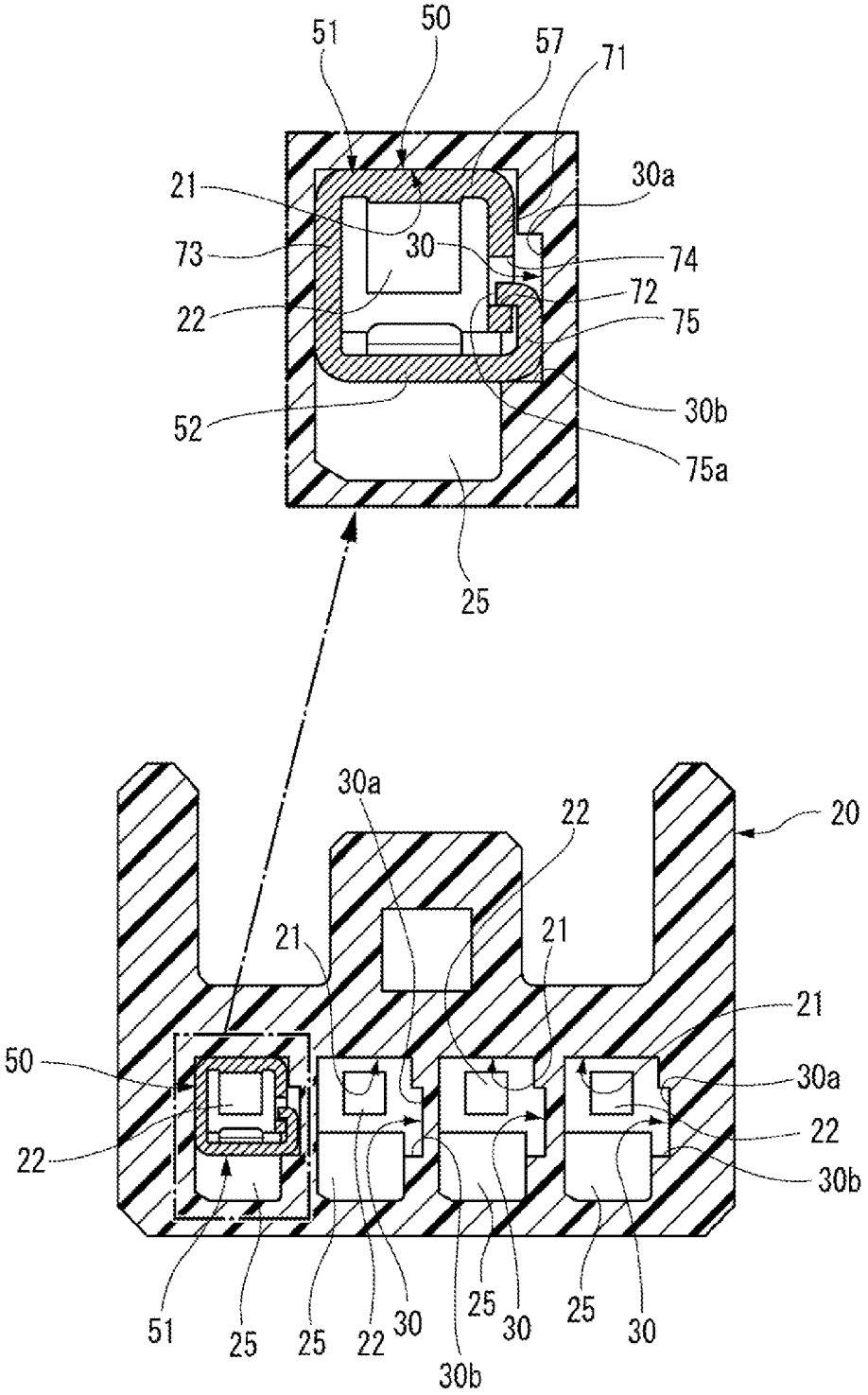
FIG. 11 includes a sectional view taken along the line J-J in FIG. 10B and its partially enlarged view.

On this occasion, as shown in FIG. 11, the lock portions 75*a*, 77*a* of the top wall holding protrusions 75, 77 overlaid on the outer side of the first side wall 71 from the front end side of the bending part of the top wall 52 are inserted and locked to the reception holes 74, 76 respectively. Thus, the top wall 52 can be prevented from being deformed in a direction to leave the first side wall 71. Accordingly, the engagement force with which the female terminal 50 keeps the box-like shape of the electric connection portion 51 can be enhanced.

As a result, even when receiving the male terminal 90, the electric connection portion 51 can be prevented from being opened, so that a sufficient contact load can be obtained by the plate spring 53. In addition, the engagement force with which the female terminal 50 keeps the box-like shape of the electric connection portion 51 can be enhanced only by general bending.

Accordingly, with the female terminal 50 according to the exemplary embodiment, the contact load is not lowered, but stable electric conduction can be secured.

Next, description will be made about a case in which the female terminal 50 is inserted into the terminal receiving chamber 21 of the female housing 20.

FIGS. 8A to 10B are sectional views for explaining operation when the female terminal 50 according to the exemplary embodiment is inserted into the terminal receiving chamber 21 of the female housing 20. FIGS. 8A to 10B correspond to sections taken along the line G-G, line H-H, line I-I and line H-H in FIG. 7, and sections taken along the line A-A and line B-B, respectively.

Figure 8A:
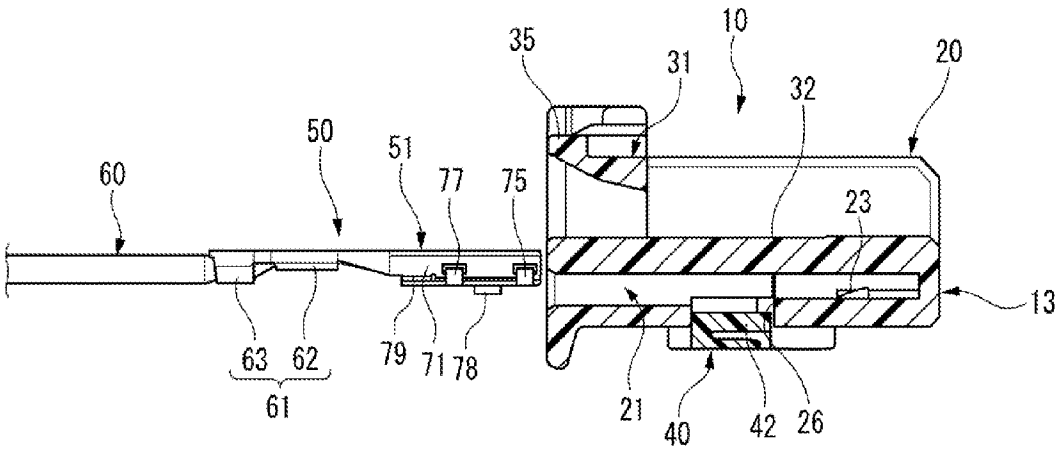
FIG. 8A is a sectional view taken along the line G-G in FIG. 7.
Figure 8B:
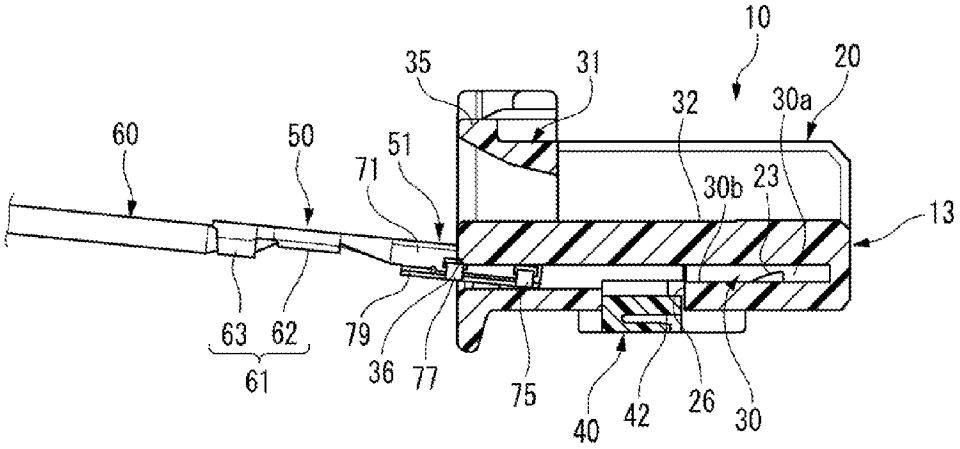
FIG. 8B is a sectional view taken along the line H-H in FIG. 7, illustrating an insertion of the female terminal into a terminal receiving chamber of the housing.
Figure 9A:
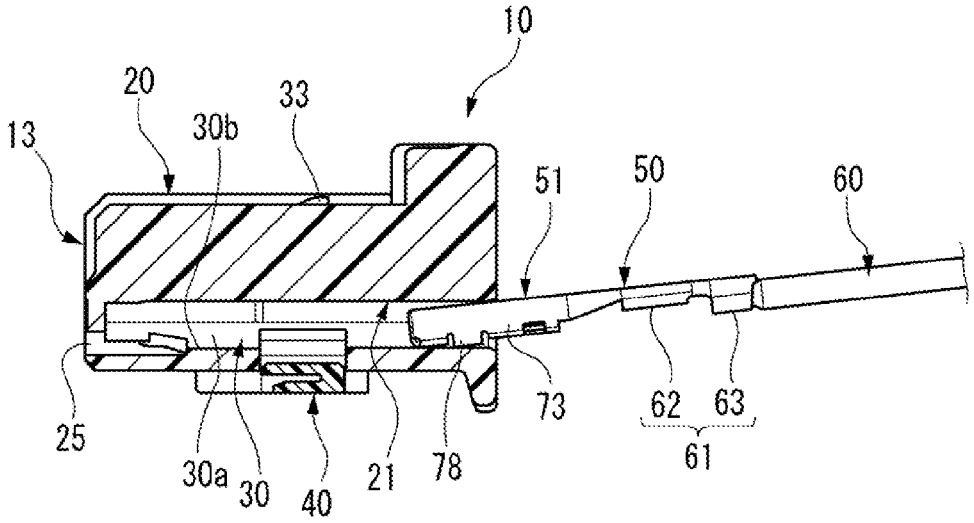
FIG. 9A is a sectional view taken along the line I-I in FIG. 7.
Figure 9B:
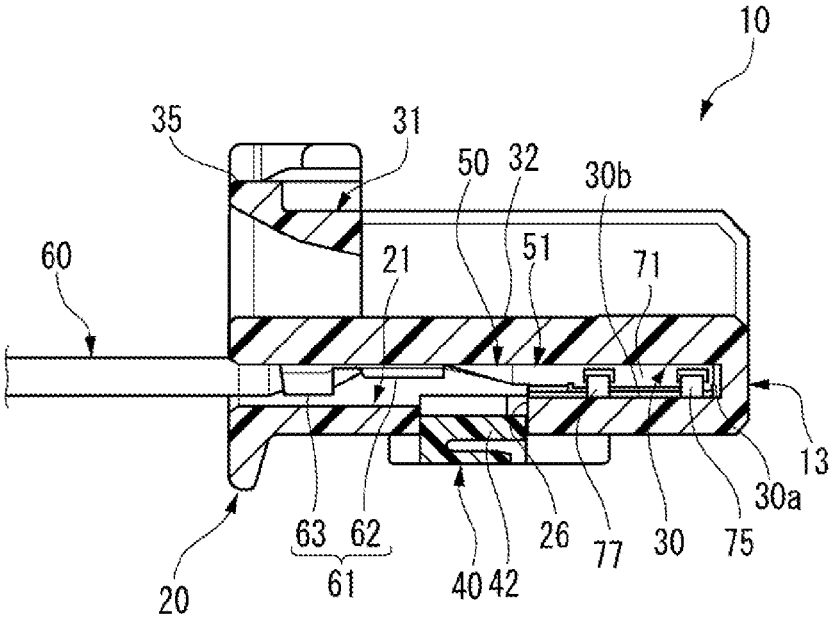
FIG. 9B is a sectional view taken along the line H-H in FIG. 7, illustrating the insertion of the female terminal into the terminal receiving chamber of the housing.

As shown in FIG. 8A, first, before attaching the female terminal 50 to the female housing 20, the retainer 40 mounted on the female housing 20 is brought into a temporary lock state. In this state, the female terminal 50 is inserted into the terminal receiving chamber 21 of the female housing 20 from its rear end side as shown in FIG. 8B and FIG. 9A. During the insertion of the female terminal 50, the top wall holding protrusions 75, 77 on the outer side of the first side wall 71 of the tubular electric connection portion 51 are guided into the engagement groove 30 by the terminal guiding taper 36.

Then, the top wall holding protrusions 75, 77 sequentially enter the engagement groove 30 provided in a recessed manner on the inner wall of the terminal receiving chamber 21. The two top wall holding protrusions 75, 77 disposed at a predetermined interval in the male terminal insertion direction of the electric connection portion 51 are inserted and guided into the engagement groove 30, so that the female terminal 50 can be inserted into the terminal receiving chamber 21 smoothly without tilting inside the terminal receiving chamber 21. Thus, the female terminal 50 can enter the terminal receiving chamber 21 without interfering with the retainer 40.

When the female terminal 50 is inserted into the terminal receiving chamber 21 in this manner, the lance 23 of the female housing 20 is pushed downward by the electric contact portion 51 of the female terminal 50 so as to be elastically deformed to be bent toward the flexible space 25*a*.

Figure 10A:
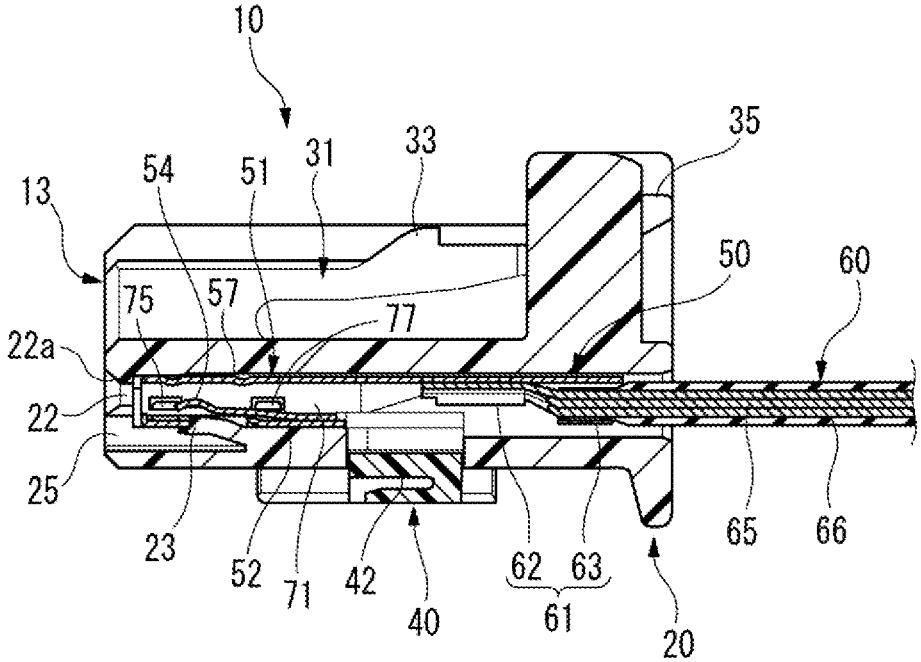
FIG. 10A is a sectional view taken along the line A-A in FIG. 1.

As shown in FIG. 10A, when the female terminal 50 is further inserted into the terminal receiving chamber 21 until the lock hole 55 of the electric connection portion 51 reaches the front end position of the lance 23, the lance 23 is released from being pressed, and the lance 23 that has been deformed till then is restored so that the front end part of the lance 23 can be fitted into the engagement hole 55. Then, the lock step portion 24 of the lance 23 is locked to the front edge portion of the lock hole 55 so that the female terminal 50 can be prevented from coming off from the terminal receiving chamber 21. Thus, the female terminal 50 is kept in a state where the female terminal 50 is received in the terminal receiving chamber 21.

Figure 10B:
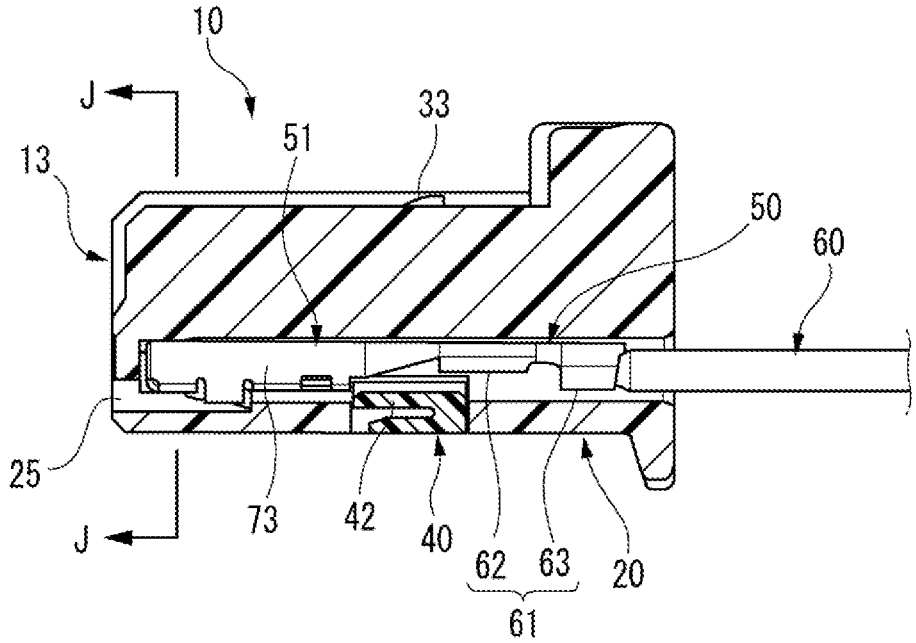
FIG. 10B is a sectional view taken along the line B-B in FIG. 1, illustrating the insertion of the female terminal into the terminal receiving chamber of the housing.

When the female terminal 50 is received in the terminal receiving chamber 21, the retainer 40 is pushed toward the female housing 20 and brought into a final lock state as shown in FIG. 10B. When the retainer 40 is thus brought into the final lock state, a part of the lock block 42 of the retainer 40 is protruded into the terminal receiving chamber 21 and disposed on the rear end side of the electric connection portion 51 of the female terminal 50. As a result, the female terminal 50 is prevented from coming off from the terminal receiving chamber 21 by the lock block 42 of the retainer 40 as well as by the lance 23.

Figure 3:
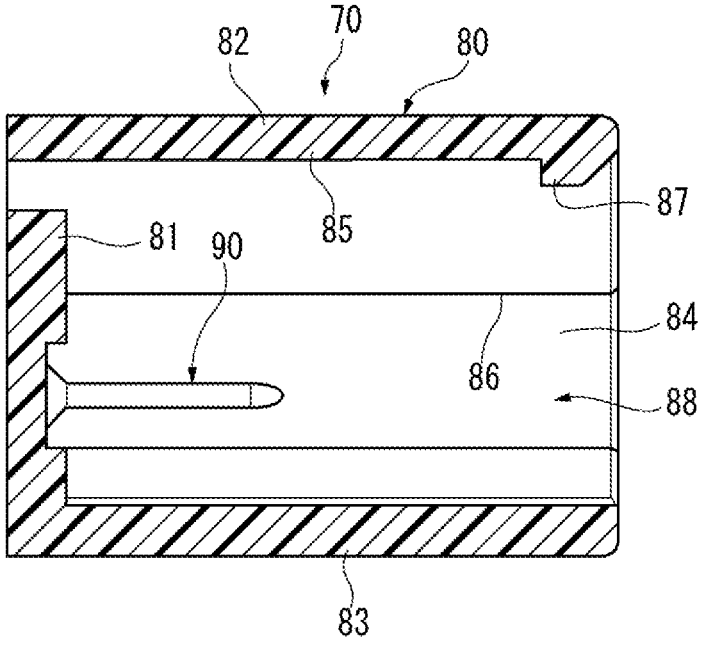
FIG. 3 is a sectional view of the counterpart connector taken along the line C-C in FIG. 1.

As shown in FIG. 3, the counterpart connector 70 is an apparatus-side connector provided in one of various pieces of apparatus. The counterpart connector 70 includes a male housing 80 and male terminals 90. The male housing 80 is molded out of electrically insulating resin, and formed integrally with a casing of the apparatus. The male housing 80 may be a separate body that can be attached to the casing of the apparatus. The male housing 80 is formed into a sectionally recessed portion including a rear wall portion 81 and a circumferential wall portion 82 extended on one side from the circumferential edge of the rear wall portion 81.

The circumferential wall portion 82 includes a bottom portion 83 forming a bottom surface, a side portion 84 forming a side surface, and a top portion 85 forming a top surface. The male housing 80 forms a fitting recess portion 88 that is opened on the opposite side to the rear wall portion 81. The fitting portion 13 of the female housing 20 is fitted into the fitting recess portion 88.

In the top portion 85 of the male housing 80, a pair of guide projections 86 are formed on the inner surface side of the top portion 85 (see FIG. 1). The guide projections 86 are formed at an interval in the width direction so as to extend in the front-rear direction of the male housing 80. In addition, in the top portion 85 of the male housing 80, locking projections 87 protruding inward are formed at the opening-side edge portion.

Each male terminal 90 is formed out of a conductive metal material such as copper or a copper alloy, and formed into a tab-like shape. A plurality of male terminals 90 are provided, and fixed to the rear wall portion 81 of the male housing 80 individually. The male terminals 90 are, for example, provided integrally with the male housing 80 by insert molding in a state where the male terminals 90 have been arranged in a line and at the same pitch as the female terminals 50 of the connector 10. Each male terminal 90 may be pressed into a press-fit hole formed in the rear wall portion 81 so as to be fixed to the rear wall portion 81. The male terminals 90 are inserted into the electric connection portions 51 of the female terminals 50 of the female housing 20 fitted into the fitting recess portion 88 such that the male terminals are electrically connected to the electric connection portions 51.

Next, description will be made about a case where the connector 10 is fitted to the counterpart connector 70.

Figure 12:
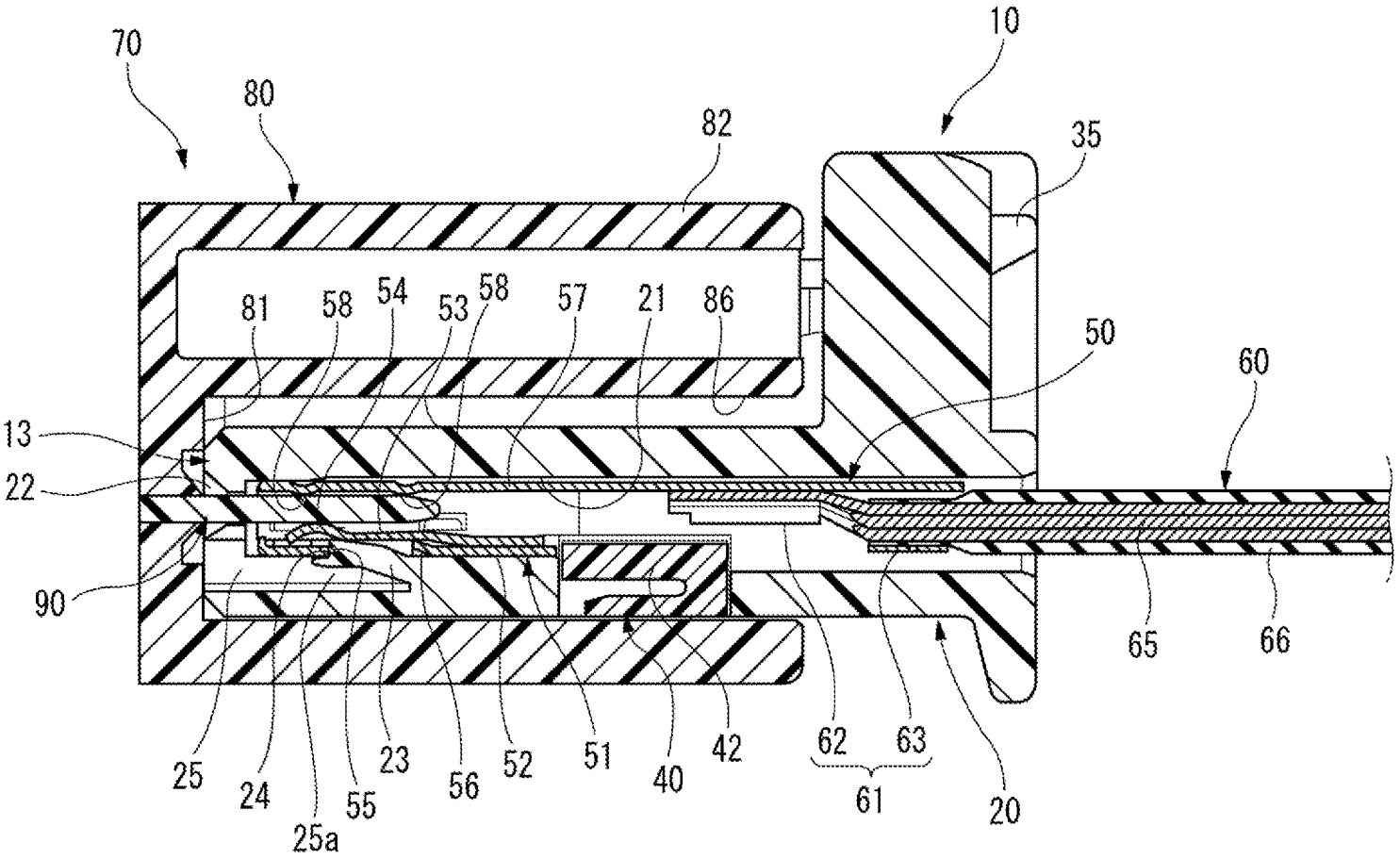
FIG. 12 is a sectional view taken along the line D-D in FIG. 2, illustrating a state in which the connector is fitted to the counterpart connector.
Figure 13:
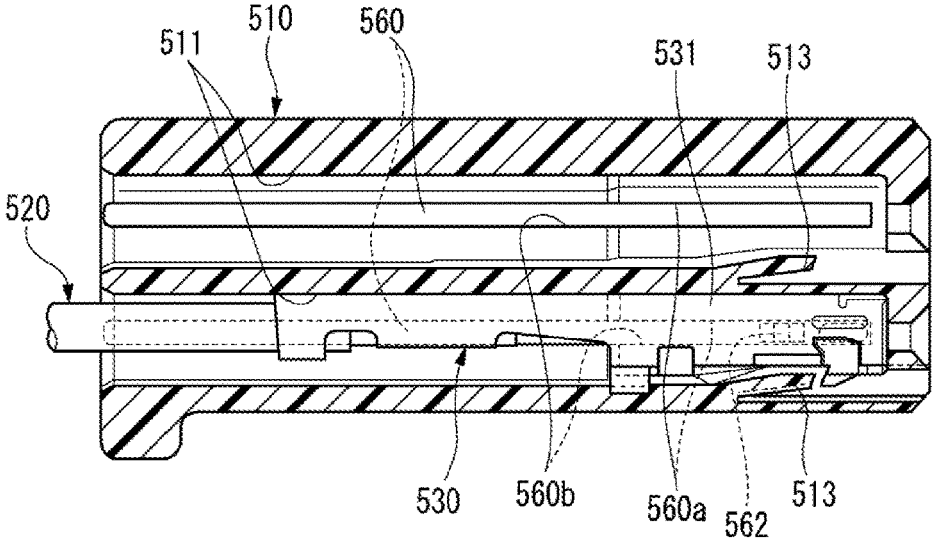
RELATED ART FIG. 13
FIG. 13 is a side sectional view of a related art connector in which a female terminal fitting is inserted into a female housing.
Figure 14:
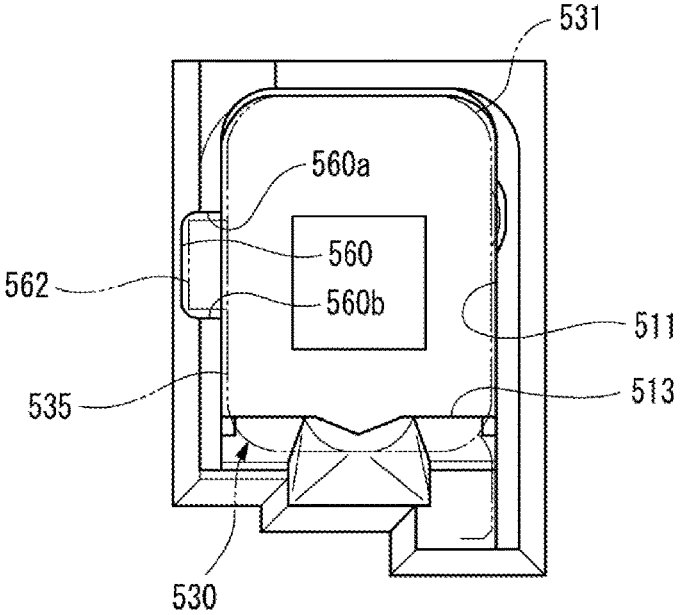
FIG. 14 RELATED ART
FIG. 14 is a rear view of a cavity showing a state in which the female terminal fitting is inserted into the female housing shown in FIG. 13.

FIG. 12 is a view illustrating a state where the connector 10 according to the exemplary embodiment is fitted into the counterpart connector 70. FIG. 12 is a sectional view taken along the line D-D in FIG. 2.

In order to fit the connector 10 to the counterpart connector 70, the front end of the female housing 20 of the connector 10 is made close to the front end of the male housing 80 of the counterpart connector 70. Then, the fitting portion 13 of the female housing 20 is inserted into the fitting recess portion 88 of the male housing 80. Thus, the guide projections 86 of the male housing 80 enter the guide grooves 32 of the female housing 20 so that the connector 10 can be guided in a direction to be fitted to the counterpart connector 70.

When the female housing 20 is inserted into the male housing 80 in this state, each male terminal 90 of the male housing 80 is inserted into the electric connection portion 51 of the corresponding female terminal 50 from the front end side opening portion 22 of the female housing 20 so that the male terminal 90 can enter between the contact point 54 of the plate spring 53 and the front contact protrusion 58 of the bottom wall 57.

When the female housing 20 is further inserted into the male housing 80, the male terminal 90 is further inserted into the electric connection portion 51 so as to push down the plate spring 53. Thus, the plate spring 53 is elastically deformed to be bent downward and brought into elastic contact with the male terminal 90. As a result, in the electric connection portion 51, the male terminal 90 is held by the front and rear contact protrusions 58 of the bottom wall 57 and the contact point 54 of the plate spring 53, so that the female terminal 50 and the male terminal 90 are electrically connected to each other.

On this occasion, the plate spring 53 bent downward abuts against the lance 23 that has entered the lock hole 55. Thus, in the electric connection portion 51 of the female terminal 50, the plate spring 53 is pressed toward the male terminal 90 by the lance 23. As a result, the plate spring 53 comes into contact with the male terminal 90 due to contact pressure in which the elastic force of the lance 23 is added to the elastic force of the plate spring 53 itself.

When the female housing 20 of the connector 10 is inserted into the male housing 80 of the counterpart connector 70 in this manner, the lock claw 33 of the lock arm 31 of the female housing 20 locks the locking projection 87 of the male housing 80. Thus, the fitting state between the connector 10 and the counterpart connector 70 is maintained.

In order to release the connector 10 from being fitted to the counterpart connector 70, the pressing portion 35 in the rear end portion of the lock arm 31 is pressed. Thus, the lock arm 31 is elastically deformed to be bent as a whole, so that the lock claw 33 of the lock arm 31 can be detached from the locking projection 87. Thus, the lock claw 33 is released from locking.

When the connector 10 is separated from the counterpart connector 70 in this state, the fitting portion 13 of the female housing 20 is pulled out from the fitting recess portion 88 of the male housing 80. Thus, the male terminals 90 are pulled out from the electric connection portions 51 of the female terminals 50 so that the female terminals 50 and the male terminals 90 can be released from electric connection to each other respectively.

As described above, according to the connector 10 according to the exemplary embodiment, when each female terminal 50 is inserted into the corresponding terminal receiving chamber 21 from the rear, the two top wall holding protrusions 75, 77 protruding on the outer side of the first side wall 71 in the tubular electric connection portion 51 sequentially enter the engagement groove 30 provided in a recessed manner on the inner wall of the terminal receiving chamber 21. The two top wall holding protrusions 75, 77 disposed at a predetermined interval in the male terminal insertion direction of the electric connection portion 51 are inserted and guided into the engagement groove 30, so that the female terminal 50 can be inserted into the terminal receiving chamber 21 smoothly without tilting inside the terminal receiving chamber 21.

The female terminal 50 received in the terminal receiving chamber 21 is supported at two locations in the engagement groove 30 at the two top wall holding protrusions 75, 77, with an interval in the female terminal insertion direction. Thus, the female terminal 50 can be prevented from tilting, and the shaking amount of the female terminal 50 can be suppressed. As a result, the female terminal 50 does not generate a variation in contact pressure with the male terminal 90. Thus, the reliability in electric connection can be enhanced.

The top wall holding protrusions 75, 77 are provided contiguously with the top wall 52 of the tubular electric connection portion 51 in a bent manner, and are overlaid on the outer side of the first side wall 71. These top wall holding protrusions 75, 77 can elastically contact the side face **30*a* and the bottom face 30*b* forming the inner walls of the engagement groove 30. Thus, the female terminal 50 can be received in the terminal receiving chamber 21** without a play.

In addition, the female terminal 50 in the connector 10 according to the exemplary embodiment has the two top wall holding protrusions 75, 77, which are disposed in front of and at the rear of the contact point 54 in the male terminal insertion direction respectively. The contact point 54 is formed in the front end portion of the plate spring 53. Therefore, when the male terminal 90 is inserted into the electric connection portion 51 of the female terminal 50, the load of the plate spring 53 in elastic contact with the male terminal 90 acts on the two top wall holding protrusions 75, 77 substantially equally so that the load can be supported by the engagement groove 30. Thus, the electric connection performance to the contact point 54 can be further improved when shaking is suppressed.

Further, in the connector 10 according to the exemplary embodiment, the terminal guiding taper 36 is formed in the terminal insertion side end portion of the engagement groove 30. Therefore, when the female terminal 50 is inserted into the terminal receiving chamber 21, the top wall holding protrusions 75, 77 are guided into the engagement groove 30 by the terminal guiding taper 36. Thus, the female terminal 50 in which the top wall holding protrusions 75, 77 are formed can be inserted into the terminal receiving chamber 21 easily.

In this manner, according to the exemplary embodiment described above, it is possible to provide a connector superior in reliability in electric connection and terminal insertability.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

According to one or more exemplary embodiments of the present invention, a connector (10) includes a female terminal (50) having a tubular electric connection portion (51), and a housing (female housing 20) having a terminal receiving chamber (21) in which the female terminal (50) is inserted along a longitudinal direction of the female terminal (50). The connector (10) is configured such that, when the connector (10) is fitted to a counterpart connector (70), a male terminal (90) of the counterpart connector (70) is inserted into the electric connection portion (51) of the female terminal (50) in the longitudinal direction and is electrically connected to the electric connection portion (51).

The electric connection portion (51) includes a bottom wall (57), a first side wall (71) having a plurality of reception holes (74, 76), a second side wall (73), the first side wall (71) and the second side wall (73) extending upright from respective sides of the bottom wall (57), the respective sides of the bottom wall (57) extending in the longitudinal direction of the female terminal (50), a plate spring (53) provided contiguously with the first side wall (71) and extending in the longitudinal direction so as to face the bottom wall, a top wall (52) provided contiguously with the second side wall (73) and overlaid on an outer side of the plate spring (53), a plurality of top wall holding protrusions (75, 77) provided contiguously with the top wall (52) and overlaid on an outer side of the first side wall, and lock portions (75*a*, 77*a*) provided contiguously with the top wall holding protrusions (75, 77) and locked at the reception holes (74, 76) of the first side wall (71). The electric connection portion (51) is bent at a boundary between the first side wall (71) and the plate spring (53), at a boundary between the second side wall (73) and the top wall (52), at a boundary between the top wall (53) and the top wall holding protrusions (75, 77), and at a boundary between the top wall holding protrusions (75, 77) and the lock portions (75*a*, 77*a*). An inner wall of the terminal receiving chamber (21) of the housing (20) includes an engagement groove (30) provided in a recessed manner along the longitudinal direction. The engagement groove (30) engages with the top wall holding protrusions (75, 77) on the outer side of the first side wall (71) to guide the female terminal (50) such that the female terminal (50) is inserted into the terminal receiving chamber (21) along the longitudinal direction.

The plate spring (53) may have a contact point (54) at a front end portion of the plate spring (53), and the top wall holding protrusions (75, 77) may be arranged such that, in the longitudinal direction, the contact point (54) is located between the top wall holding protrusions (75, 77).

An end portion of the engagement groove (30) from which the female terminal (50) is inserted may have a terminal guiding taper (36) to guide the top wall holding protrusions (75, 77) into the engagement groove (30).

What is claimed is:

1. A connector comprising:

a female terminal having a tubular electric connection portion; and a housing having a terminal receiving chamber in which the female terminal is inserted along a longitudinal direction of the female terminal, wherein the connector is configured such that, when the connector is fitted to a counterpart connector, a male terminal of the counterpart connector is inserted into the electric connection portion of the female terminal in the longitudinal direction and is electrically connected to the electric connection portion, wherein the electric connection portion comprises:

a bottom wall;

a first side wall having a plurality of reception holes;

a second side wall, the first side wall and the second side wall extending upright from respective sides of the bottom wall, the respective sides of the bottom wall extending in the longitudinal direction of the female terminal;

a plate spring provided contiguously with the first side wall and extending in the longitudinal direction so as to face the bottom wall;

a top wall provided contiguously with the second side wall and overlaid on an outer side of the plate spring;

a plurality of top wall holding protrusions provided contiguously with the top wall and overlaid on an outer side of the first side wall; and lock portions provided contiguously with the top wall holding protrusions and locked at the reception holes of the first side wall, wherein the electric connection portion is bent at a boundary between the first side wall and the plate spring, at a boundary between the second side wall and the top wall, at a boundary between the top wall and the top wall holding protrusions, and at a boundary between the top wall holding protrusions and the lock portions, and wherein an inner wall of the terminal receiving chamber of the housing includes an engagement groove provided in a recessed manner along the longitudinal direction, the engagement groove engaging with the top wall holding protrusions on the outer side of the first side wall to guide the female terminal such that the female terminal is inserted into the terminal receiving chamber along the longitudinal direction.

2. The connector according to claim 1, wherein the plate spring has a contact point at a front end portion of the plate spring, and wherein the top wall holding protrusions are arranged such that, in the longitudinal direction, the contact point is located between the top wall holding protrusions.

3. The connector according to claim 1, wherein an end portion of the engagement groove, from which the female terminal is inserted, has a terminal guiding taper to guide the top wall holding protrusions into the engagement groove.

* * * * *